US009830859B2

(12) United States Patent
Wang et al.

(10) Patent No.: US 9,830,859 B2
(45) Date of Patent: Nov. 28, 2017

(54) PIXEL CIRCUIT AND DRIVING METHOD THEREOF, DISPLAY PANEL AND DISPLAY APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Di Wang, Beijing (CN); Hao Zhang, Beijing (CN); Lingyun Shi, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/514,822

(22) PCT Filed: Feb. 18, 2016

(86) PCT No.: PCT/CN2016/073983
§ 371 (c)(1),
(2) Date: Mar. 27, 2017

(87) PCT Pub. No.: WO2017/041439
PCT Pub. Date: Mar. 16, 2017

(65) Prior Publication Data

US 2017/0249897 A1 Aug. 31, 2017

(30) Foreign Application Priority Data

Sep. 7, 2015 (CN) ..... 2015 1 0563965

(51) Int. Cl.
*G09G 3/30* (2006.01)
*G09G 3/3233* (2016.01)
(Continued)

(52) U.S. Cl.
CPC ..... *G09G 3/3233* (2013.01); *G09G 3/3266* (2013.01); *G09G 3/3291* (2013.01); *G09G 2300/0809* (2013.01)

(58) Field of Classification Search
CPC .. G09G 3/12; G09G 3/14; G09G 3/30; G09G 3/32; G09G 3/3208; G09G 3/3225; G09G 3/3233; G09G 3/3241; G09G 3/325
See application file for complete search history.

(56) References Cited

U.S. PATENT DOCUMENTS 8,188,948 B2 5/2012 Choi et al.
2003/0227262 A1* 12/2003 Kwon ..... G09G 3/325 315/169.3
2014/0209868 A1* 7/2014 Sun ..... G09G 3/30 257/40

FOREIGN PATENT DOCUMENTS

CN 1567412 A 1/2005
CN 1652185 A 8/2005
(Continued)

OTHER PUBLICATIONS

International Search Report and Written Opinion, for PCT Patent Application No. PCT/CN2016/073983, dated Jun. 1, 2016.
(Continued)

*Primary Examiner* — Ilana Spar
*Assistant Examiner* — Nguyen H Truong
(74) *Attorney, Agent, or Firm* — Kinney & Lange, P.A.

(57) ABSTRACT

The present disclosure provides a pixel circuit and a driving method thereof, a display panel and a display apparatus. In the pixel circuit, a driving transistor has one of a source and
(Continued)

a drain connected to a control voltage line, and the other connected to a light-emitting device; a storage capacitor has a first terminal connected to a gate of the driving transistor and a second terminal connected to the control voltage line; a conducting unit has a first terminal connected to a scanning line, a second terminal connected to a data line, a third terminal connected to a first terminal of an addressing unit, and a fourth terminal connected to a common terminal, and is configured to conduct a connection between the second terminal and the third terminal when the first terminal is at a first level and conduct a connection between the third terminal and the fourth terminal when the first terminal is at a second level; and the addressing unit has a second terminal connected to the data line and a third terminal connected to the first terminal of the storage capacitor, and is configured to conduct a connection between the second terminal and the third terminal when the first terminal is at a valid level.

20 Claims, 4 Drawing Sheets

(51) Int. Cl.
*G09G 3/3266* (2016.01)
*G09G 3/3291* (2016.01)

(56) References Cited

FOREIGN PATENT DOCUMENTS

| | | | |
|---|---|---|---|
| CN | 101051441 | A | 10/2007 |
| CN | 102708792 | A | 10/2012 |
| CN | 105047169 | A | 11/2015 |

OTHER PUBLICATIONS

International Search Report and Written Opinion, for PCT Patent Application No. PCT/CN2016/073983, dated Jun. 1, 2016, 10 pages.

* cited by examiner

PIXEL CIRCUIT AND DRIVING METHOD THEREOF, DISPLAY PANEL AND DISPLAY APPARATUS

CROSS-REFERENCE TO RELATED APPLICATION(S)

This application claims priority to the Chinese Patent Application No. 201510563965.6, filed on Sep. 7, 2015, entitled "PIXEL CIRCUIT AND DRIVING METHOD THEREOF, DISPLAY PANEL AND DISPLAY APPARATUS" which is incorporated herein by reference in its entirety.

TECHNICAL FIELD

The present disclosure relates to a field of display technology, and more particularly, to a pixel circuit and a driving method thereof, a display panel and a display apparatus.

BACKGROUND

Differently from a voltage driving manner for conventional Liquid Crystal Display (LCD) devices, Organic Light-Emitting Diode (OLED) devices are driven by a current, and therefore, in a pixel circuit where each OLED device is located, in addition to a current-driven control switch, there is also a need for an addressing switch for writing a data voltage. Conventionally, the addressing switch is implemented by a Thin Film Transistor (TFT). Thus, a scanning line is required to supply a scanning signal to a gate of a TFT of each addressing switch. As a result, when input impedance of a pixel circuit in an input position of the scanning signal is not large enough, amplitude of a voltage of the scanning signal may be degraded partly after the scanning signal passes through a pixel circuit, which easily causes a pixel circuit at the end of the scanning line not to be able to receive the scanning signal and therefore not to be able to normally supply a driving current, resulting in poor display.

SUMMARY

The present disclosure provides a pixel circuit and a driving method thereof, a display panel and a display apparatus, which is directed to a problem that when the input impedance in the input position of the scanning signal is small, the amplitude of the scanning signal is degraded in the transmission process.

In a first aspect, the present disclosure provides a pixel circuit, comprising: a light-emitting device, a driving transistor, a storage capacitor, a conducting unit, and an addressing unit, wherein, the driving transistor has one of a source and a drain connected to a control voltage line, and the other connected to the light-emitting device;

the storage capacitor has a first terminal connected to a gate of the driving transistor and has a second terminal connected to the control voltage line;

the conducting unit has a first terminal connected to a scanning line, a second terminal connected to a data line, a third terminal connected to a first terminal of the addressing unit, and a fourth terminal connected to a common terminal, and is configured to conduct a connection between the second terminal and the third terminal when the first terminal is at a first level and conduct a connection between the third terminal and the fourth terminal when the first terminal is at a second level; and the addressing unit has a second terminal connected to the data line and a third terminal connected to the first terminal of the storage capacitor, and is configured to conduct a connection between the second terminal and the third terminal when the first terminal is at a valid level.

According to an example, the conducting unit comprises a first N-type transistor and a first P-type transistor, wherein the first N-type transistor has a gate connected to the scanning line, one of a source and a drain connected to the first terminal of the addressing unit, and the other connected to the common terminal;

the first P-type transistor has a gate connected to the scanning line, one of a source and a drain connected to the first terminal of the addressing unit, and the other connected to the data line; and the first level is a low level and the second level is a high level.

According to an example, the conducting unit comprises a second N-type transistor, a second P-type transistor, a third N-type transistor and a third P-type transistor, wherein the second N-type transistor has a gate connected to the scanning line, one of a source and a drain connected to gates of the third N-type transistor and the third P-type transistor, and the other connected to the common terminal;

the second P-type transistor has a gate connected to the scanning line, one of a source and a drain connected to the gates of the third N-type transistor and the third P-type transistor, and the other connected to the data line;

the third N-type transistor has one of a source and a drain connected to the first terminal of the addressing unit, and the other connected to the common terminal;

the third P-type transistor has one of a source and a drain connected to the first terminal of the addressing unit, and the other connected to the data line; and the first level is a high level and the second level is a low level.

According to an example, the conducting unit comprises a first N-type transistor and a first P-type transistor, wherein the first N-type transistor has a gate connected to the scanning line, one of a source and a drain connected to the first terminal of the addressing unit, and the other connected to the data line;

the first P-type transistor has a gate connected to the scanning line, one of a source and a drain connected to the first terminal of the addressing unit, and the other connected to the common terminal; and the first level is a high level and the second level is a low level.

According to an example, the conducting unit comprises a second N-type transistor, a second P-type transistor, a third N-type transistor and a third P-type transistor, wherein the second N-type transistor has a gate connected to the scanning line, one of a source and a drain connected to gates of the third N-type transistor and the third P-type transistor, and the other connected to the data line;

the second P-type transistor has a gate connected to the scanning line, one of a source and a drain connected to the gates of the third N-type transistor and the third P-type transistor, and the other connected to the common terminal;

the third N-type transistor has one of a source and a drain connected to the first terminal of the addressing unit, and the other connected to the data line;

the third P-type transistor has one of a source and a drain connected to the first terminal of the addressing unit, and the other connected to the common terminal; and the first level is a high level and the second level is a low level.

According to an example, the addressing unit comprises a P-type thin film transistor and the valid level is a low level.

According to an example, the light-emitting device is an organic light-emitting diode.

In a second aspect, the present disclosure further provides a method for driving any of the pixel circuits described above, comprising:

setting the scanning line to the first level, so that a data voltage on the data line is conducted to the first terminal of the addressing unit as an invalid level; and setting the scanning line to the second level, so that a common terminal voltage on the common terminal is conducted to the first terminal of the addressing unit as a valid level, the addressing unit conducts the data voltage on the data line to the first terminal of the storage capacitor, and the driving transistor supplies a driving current to the light-emitting device under the control of a voltage across the storage capacitor.

According to an example, the addressing unit comprises a P-type thin film transistor and the valid level is a low level.

According to an example, the light-emitting device is an organic light-emitting diode.

In a third aspect, the present disclosure further provides a display panel, comprising any of the pixel circuits described above.

In a fourth aspect, the present disclosure further provides a display apparatus, comprising any of the display panels described above.

BRIEF DESCRIPTION OF THE DRAWINGS

In order to more clearly describe the technical solutions according to the embodiments of the present disclosure or in the conventional technique, accompanying drawings required to be used in the description of the embodiments or the conventional technique will be described briefly below. Obviously, the accompanying drawings in the following description are some embodiments of the present disclosure, and other accompanying drawings can be obtained by those of ordinary skill in the art according to these accompanying drawings without creative effort.

DETAILED DESCRIPTION

In order to make the purposes, technical solutions and advantages of the embodiments of the present disclosure more clear, the technical solutions according to the embodiments of the present disclosure will be described clearly and completely in conjunction with the accompanying drawings in the embodiments of the present disclosure. It will be apparent that the described embodiments are some of the embodiments of the present disclosure, instead of all the embodiments. All other embodiments obtained by those of ordinary skill in the art based on the embodiments of the present disclosure without creative work are within the protection scope of the present disclosure.

Figure 1:
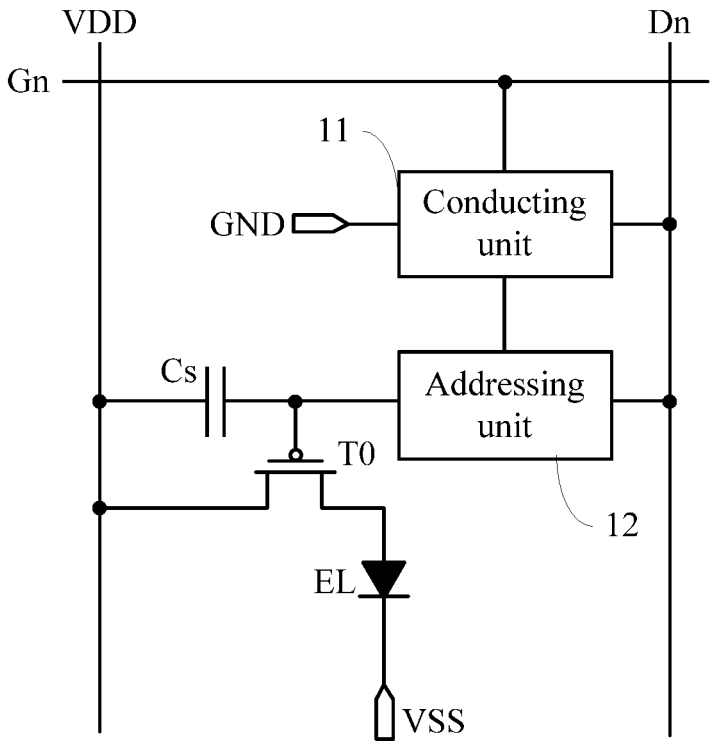
FIG. 1 is a structural block diagram of a pixel circuit according to an embodiment of the present disclosure.

FIG. 1 is a structural block diagram of a pixel circuit according to an embodiment of the present disclosure. As shown in FIG. 1, the pixel circuit comprises a light-emitting device EL, a driving transistor T0, a storage capacitor Cs, a conducting unit 11 and an addressing unit 12, wherein, the driving transistor T0 has one of a source and a drain connected to a control voltage line VDD, and the other connected to the light-emitting device EL;

the storage capacitor Cs has a first terminal connected to a gate of the driving transistor T0 and a second terminal connected to the control voltage line VDD;

the conducting unit 11 has a first terminal connected to a scanning line Gn, a second terminal connected to a data line Dn, a third terminal connected to a first terminal of the addressing unit 12, and a fourth terminal connected to a common terminal GND, and is configured to conduct a connection between the second terminal and the third terminal when the first terminal is at a first level and conduct a connection between the third terminal and the fourth terminal when the first terminal is at a second level; and the addressing unit 12 has a second terminal connected to the data line Dn and a third terminal connected to the first terminal of the storage capacitor Cs, and is configured to conduct a connection between the second terminal and the third terminal when the first terminal is at a valid level.

For example, when the scanning line Gn is at a first level, the conducting unit 11 conducts a connection between the data line Dn and the addressing unit 12, so that the first terminal of the addressing unit 12 can receive a valid level from the data line Dn (even if all data voltages are included in a range of the valid level), thereby conducting a connection between the data line Dn and the first terminal of the storage capacitor Cs. In this case, the control voltage line VDD connected to the second terminal of the storage capacitor Cs may be supplied with a high level bias voltage, so that a data voltage from the data line Dn is written into the storage capacitor Cs by charging the storage capacitor Cs.

Thereafter, the scanning line Gn transitions to a second level, and the conducting unit 11 conducts a connection between the common terminal GND and the addressing unit 12, so that the first terminal of the addressing unit 12 can receive an invalid level from the common terminal GND, and thereby the data line Dn is disconnected from the first terminal of the storage capacitor Cs. In this case, a voltage stored across the storage capacitor Cs is applied to the gate and the source of the driving transistor T0, so that a driving current flowing to the light-emitting device EL is formed in the driving transistor T0.

It can be understood that magnitude of the driving current is related to magnitude of a gate-to-source voltage of the driving transistor T0 and therefore is also related to magnitude of the data voltage written into the storage capacitor Cs. Thus, the light-emitting device EL may emit light under the driving of the driving current in a case that the bias voltage VSS is connected to the other terminal thereof and intensity of the light emission is related to the magnitude of the driving current. It can be seen that the pixel circuit can realize light emission of single-point pixels for display.

It should be illustrated that the terms "high level" and "low level", or "first level" and 'second level", or "valid level" and "invalid level" herein are two logic states represented by a potential level range at a position of a certain circuit node. It can be understood that a specific potential level range may be set as desired in a specific application scenario, which is not limited by the present disclosure.

It should be illustrated that the driving transistor shown in FIG. 1 is a P-type transistor (the connection between the source and the drain is conducted when the gate is at a low level), but in other embodiments of the present disclosure, the driving transistor may be substituted with an N-type transistor (the connection between the source and the drain is conducted when the gate is at a high level), and the same working flow may be implemented after the level of the circuit is adaptively adjusted, which is not limited by the present disclosure.

It can be seen that the conducting unit 11 according to the embodiment of the present disclosure can have very low input impedance and very high output impedance, thereby enhancing the capability of the scanning line to drive the load. Thus, the embodiment of the present disclosure can prevent the amplitude of the voltage of the scanning signal from being degraded when the scanning signal passes through a pixel circuit. On the other hand, the conducting unit according to the embodiment of the present disclosure can have a very low static power, which contributes to reduction in power consumption of the circuit.

Figure 2:
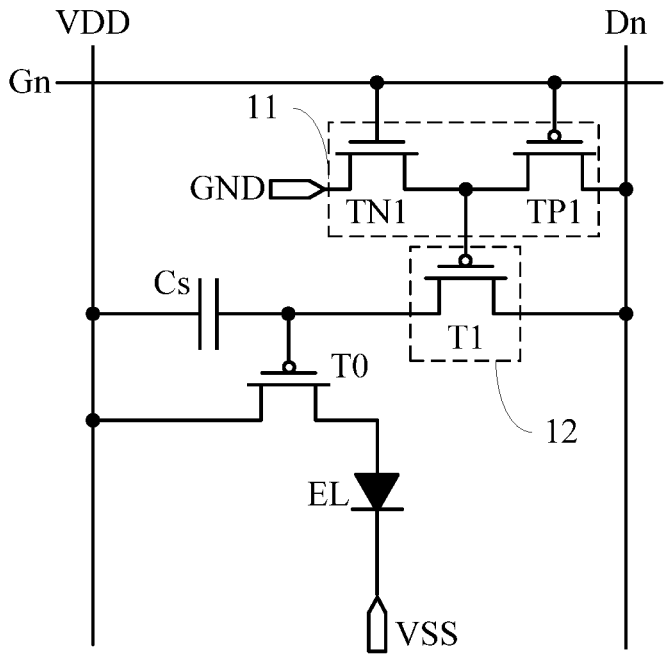
FIG. 2 is a circuit structural diagram of a pixel circuit according to an embodiment of the present disclosure.

As a specific structural example of the conducting unit 11 and the addressing unit 12, FIG. 2 is a circuit structural diagram of a pixel circuit according to an embodiment of the present disclosure. As shown in FIG. 2, the addressing unit 12 according to the embodiment of the present disclosure comprises a P-type thin film transistor T1 which has a gate as the first terminal of the addressing unit 12, a source as the second terminal of the addressing unit 12 and a drain as the third terminal of the addressing unit 12. Thereby, the valid level of the addressing unit 12 is a low level and the invalid level of the addressing unit 12 is a high level.

In FIG. 2, the conducting unit 11 comprises a first N-type transistor TN1 and a first P-type transistor TP1, wherein the first N-type transistor TN1 has a gate connected to the scanning line Gn, one of a source and a drain connected to the first terminal of the addressing unit 12, and the other connected to the common terminal GND; and the first P-type transistor TP1 has a gate connected to the scanning line Gn, one of a source and a drain connected to the first terminal of the addressing unit 12, and the other connected to the data line Dn. In the embodiment of the present disclosure, the first level described above is a low level, and the second level described above is a high level. It can be understood that when the scanning line Gn transitions from the low level to the high level, the first N-type transistor TN1 is turned on while the first P-type transistor TP1 is turned off, so that the conducting unit 11 outputs a low level from the common terminal GND to the addressing unit 12, and thereby the addressing unit 12 realizes writing the data voltage into the storage capacitor Cs. When the scanning line Gn transitions from the high level to the low level, the first N-type transistor TN1 is turned off and the first P-type transistor TP1 is turned on, so that the conducting unit 11 outputs a high level from the data line Dn to the addressing unit 12, and thereby the addressing unit 12 disconnects the data line Dn from the second terminal of the storage capacitor Cs. It can be seen that the conducting unit 11 can realize inverted output of the signal on the scanning line Gn.

Figure 3:
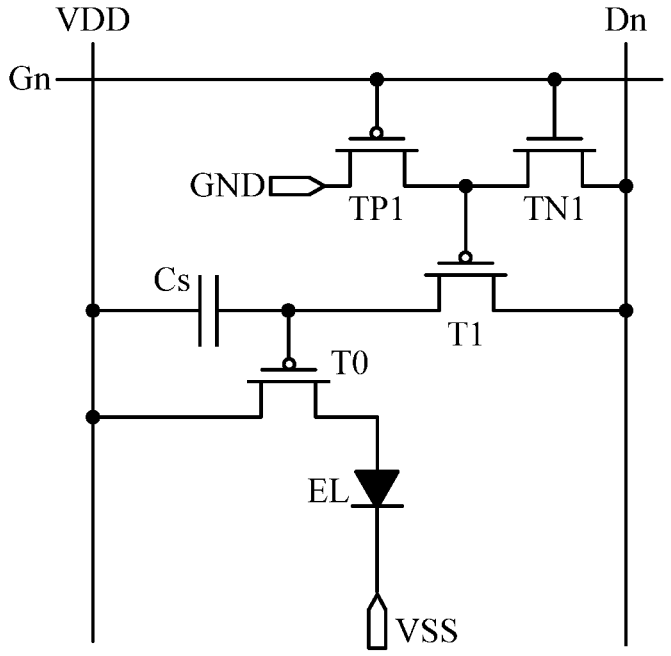
FIG. 3 is a circuit structural diagram of a pixel circuit according to another embodiment of the present disclosure.

Similarly, FIG. 3 is a circuit structural diagram of a pixel circuit according to another embodiment of the present disclosure. As shown in FIG. 3, the conducting unit 11 in the pixel circuit comprises a first N-type transistor TN1 and a first P-type transistor TP1, wherein the first N-type transistor TN1 has a gate connected to the scanning line Gn, one of a source and a drain connected to the first terminal of the addressing unit 12, and the other connected to the data line Dn; and the first P-type transistor TP1 has a gate connected to the scanning line Gn, one of a source and a drain connected to the first terminal of the addressing unit 12, and the other connected to the common terminal GND. It can be seen that as compared with the pixel circuit shown in FIG. 2, the pixel circuit shown in FIG. 3 exchanges positions and connection relationships of the first N-type transistor TN1 and the first P-type transistor TP1, so that in-phase output of the signal on the scanning line Gn is realized with a high level as the first level described above and a low level as the second level described above, and the description thereof will not be repeated here.

It can be seen that in the pixel circuits shown in FIGS. 2 and 3, the conducting unit 11 can output a level which is logically opposite to or the same as that on the scanning line Gn to the addressing unit 12, and can substantially increase the input impedance of the pixel circuit in the input position of the scanning signal, and in addition, the static power consumption of the conducting unit 11 is zero in a case that a leakage current is neglected. Therefore, the present disclosure can avoid the amplitude of the voltage of the scanning signal from being degraded after the scanning signal passes through a pixel circuit, and contributes to reduction in power consumption of the circuit.

Figure 4:
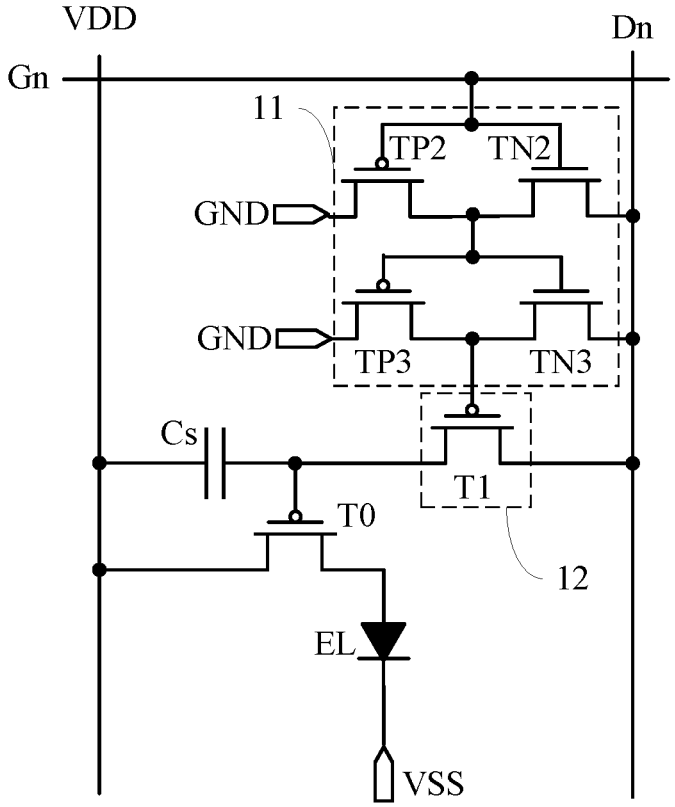
FIG. 4 is a circuit structural diagram of a pixel circuit according to another embodiment of the present disclosure.

As a specific structural example of another conducting unit 11, FIG. 4 is a circuit structural diagram of a pixel circuit according to another embodiment of the present disclosure. As shown in FIG. 4, the conducting unit 11 according to the embodiment of the present disclosure comprises a second N-type transistor TN2, a second P-type transistor TP2, a third N-type transistor TN3 and a third P-type transistor TP3, wherein the second N-type transistor TN2 has a gate connected to the scanning line Gn, one of a source and a drain connected to gates of the third N-type transistor TN3 and the third P-type transistor TP3, and the other connected to the data line Dn;

the second P-type transistor TP2 has a gate connected to the scanning line Gn, one of a source and a drain connected to the gates of the third N-type transistor TN3 and the third P-type transistor TP3, and the other connected to the common terminal GND;

the third N-type transistor TN3 has one of a source and a drain connected to the first terminal of the addressing unit 12, and the other connected to the data line Dn; and the third P-type transistor TP3 has one of a source and a drain connected to the first terminal of the addressing unit 12, and the other connected to the common terminal GND.

It can be seen that in the embodiment of the present disclosure, a high level is used as the first level described above, and a low level is used as the second level described above. Specifically, when the scanning line Gn is at the high level, the second N-type transistor TN2 is turned on and the high level on the data line Dn is conducted to the gates of the third N-type transistor TN3 and the third P-type transistor TP3, so that the third N-type transistor TN3 is turned on and the high level on the data line Dn is conducted to the first terminal of the addressing module 12. When the scanning line Gn is at the low level, the second P-type transistor TP2 is turned on and the low level on the common terminal GND is conducted to the gates of the third N-type transistor TN3 and the third P-type transistor TP3, so that the third P-type transistor TP3 is turned on and the low level on the common terminal GND is conducted to the first terminal of the addressing module 12, so as to conduct a connection between the data line Dn and the first terminal of the storage capacitor Cs. In this case, the control voltage line VDD connected to the second terminal of the storage capacitor Cs may be supplied with a high level bias voltage, so that the data voltage from the data line Dn is written into the storage capacitor Cs by charging the storage capacitor Cs.

It can be seen that in the embodiment of the present disclosure, the input impedance of the pixel circuit in the input position of the scanning signal is further increased in the pixel circuit shown in FIG. 3, so that the amplitude of the voltage of the scanning signal can be further prevented from being degraded after the scanning signal passes through a pixel circuit.

Figure 5:
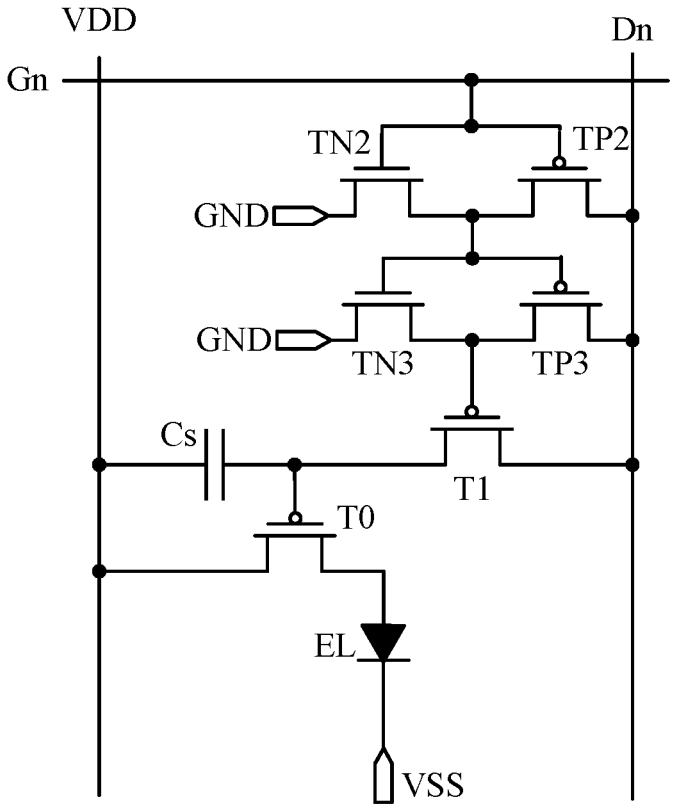
FIG. 5 is a circuit structural diagram of a pixel circuit according to another embodiment of the present disclosure.

Similarly, FIG. 5 is a circuit structural diagram of a pixel circuit according to another embodiment of the present disclosure. As shown in FIG. 5, the conducting unit 11 according to the embodiment of the present disclosure comprises a second N-type transistor TN2, a second P-type transistor TP2, a third N-type transistor TN3 and a third P-type transistor TP3, wherein the second N-type transistor TN2 has a gate connected to the scanning line Gn, one of a source and a drain connected to gates of the third N-type transistor TN3 and the third P-type transistor TP3, and the other connected to the common terminal GND;

the second P-type transistor TP2 has a gate connected to the scanning line Gn, one of a source and a drain connected to the gates of the third N-type transistor TN3 and the third P-type transistor TP3, and the other connected to the data line Dn;

the third N-type transistor TN3 has one of a source and a drain connected to the first terminal of the addressing unit 12, and the other connected to the common terminal GND; and the third P-type transistor TP3 has one of a source and a drain connected to the first terminal of the addressing unit 12, and the other connected to the data line Dn.

It can be seen that in the embodiment of the present disclosure, a high level is used as the first level described above, and a low level is used as the second level described above. Specifically, when the scanning line Gn is at the high level, the second N-type transistor TN2 is turned on and the low level on the common terminal GND is conducted to the gates of the third N-type transistor TN3 and the third P-type transistor TP3, so that the third P-type transistor TP3 is turned on and the high level on the data line Dn is conducted to the first terminal of the addressing module 12. When the scanning line Gn is at the low level, the second P-type transistor TP2 is turned on and the high level on the data line Dn is conducted to the gates of the third N-type transistor TN3 and the third P-type transistor TP3, so that the third N-type transistor TN3 is turned on and the low level on the common terminal GND is conducted to the first terminal of the addressing module 12. Thereby, the addressing module 12 is conducted, so as to conduct a connection between the data line Dn and the first terminal of the storage capacitor Cs. In this case, the control voltage line VDD connected to the second terminal of the storage capacitor Cs may be supplied with a high level bias voltage, so that the data voltage from the data line Dn is written into the storage capacitor Cs by charging the storage capacitor Cs.

It can be seen that in the embodiment of the present disclosure, the input impedance of the pixel circuit in the input position of the scanning signal is further increased in the pixel circuit shown in FIG. 2, and therefore the amplitude of the voltage of the scanning signal can be prevented from being degraded after the scanning signal passes through a pixel circuit.

It is to be further understood that in any of the pixel circuits described above, if a high level is to be set as the valid level of the addressing unit 12, the P-type thin film transistor may be replaced with an N-type thin film transistor, which is not limited by the disclosure. It is to be illustrated that the P-type transistor has a characteristic that there is no loss of a threshold voltage when a high level of the data voltage is transmitted. Therefore, it is preferable to use a P-type thin film transistor as the addressing unit 12 described above in practical applications.

It is to be illustrated that a manner in which a source and a drain of any of the transistors described above are connected can be determined according to a type of the transistor which is selected, and when the transistor has a structure in which the source and the drain are symmetrical, the source and the drain can be considered as two electrodes which are not particularly distinguished. This is well known to those skilled in the art and will not be described in detail here.

In addition, in any of the pixel circuits described above, the light-emitting device EL may specifically be an Organic Light-emitting diode (OLED), and may further be used to realize display in a form of an OLED.

Based on the same inventive concept, the embodiments of the present disclosure provide a method for driving any of the pixel circuits described above, comprising:

setting the scanning line to be at a first level, so that a data voltage on the data line is conducted to the first terminal of the addressing unit as an invalid level; and setting the scanning line to be at a second level, so that a common terminal voltage on the common terminal is conducted to the first terminal of the addressing unit as a valid level, the addressing unit conducts the data voltage on the data line to the first terminal of the storage capacitor, and the driving transistor supplies a driving current to the light-emitting device under the control of a voltage across the storage capacitor.

It is to be understood that the driving method according to the embodiments of the present disclosure corresponds to the operation principle of any of the pixel circuits described above, and accordingly can comprise corresponding specific steps, which will not be described here.

Based on the same inventive concept, the embodiments of the present disclosure provide a display panel comprising any of the pixel circuits, and accordingly have the advantages of any of the display circuits described above. For example, when the light-emitting device described above is an OLED, the display panel may have a specific structure of an OLED panel, and may form all structures of any of the pixel circuits except for the light-emitting device in each of pixel areas on an array substrate of the display panel, to realize light emission in a form of an OLED for display.

Based on the same inventive concept, the embodiments of the present disclosure provide a display apparatus comprising any of the display panels described above, and accordingly have the advantages of any of the display panels described above. It should be illustrated that the display apparatus according to the present embodiment may be any product or component having a display function such as an electronic paper, a mobile phone, a tablet computer, a television, a notebook computer, a digital photo frame, a navigator etc.

It can be known from the above-mentioned technical solutions that, the conducting unit according to the present disclosure can have very low input impedance and very high output impedance, thereby enhancing the capability of the scanning line to drive the load. Thereby, the present disclosure can prevent the amplitude of the voltage of the scanning signal from being degraded after the scanning signal passes through a pixel circuit. On the other hand, the conducting unit according to the present disclosure can have a very low quiescent power, which contributes to reduction in power consumption of the circuit.

It should be illustrated in the description of the present disclosure that an orientation or position relation indicated by terms such as "up", "down" or the like is an orientation or position relation indicated in the accompanying drawings, and is merely used to conveniently describe the present disclosure and simplify the description, instead of indicating or implying that the indicated apparatus or element must have a particular orientation and must be constructed and operated in a particular orientation, and thus cannot be construed as limiting the present disclosure. Unless otherwise explicitly specified or defined, terms such as "be installed in", "be connected with", "be connected to" or the like should be construed in a generalized sense. For example, these terms may refer to "be fixedly connected to", "be detachably connected to", or "be integrally connected to"; or may be "be mechanically connected to", or "be electrically connected to"; or may be "be directly connected to" or "be indirectly connected through an intermediate medium", or may be "connectivity in two elements". Specific meanings of the terms described above in the present disclosure can be understood by those skilled in the art according to specific conditions.

A number of specific details have been described in the specification of the present disclosure. However, it should be understood that the embodiments of the present disclosure may be practiced without these specific details. In some instances, well-known methods, structures and technologies have not been described in detail to avoid obscuring the specification.

Similarly, it should be understood that in order to simplify the present disclosure and facilitate understanding of one or more of various aspects of the present disclosure, in the description of the exemplary embodiments of the present disclosure described above, various features of the present disclosure sometimes are grouped into a single embodiment, figure or description thereof. However, the method according to the present disclosure should not be construed as reflecting that the present disclosure to be protected claims more features than those explicitly recited in each claim. Rather, as described in the claims, an aspect of the present disclosure comprises less features than all features in the single embodiment disclosed above. Therefore, the claims which follow the detailed description are explicitly hereby incorporated into the detailed description, and each claim per se is used as a separate embodiment of the present disclosure.

It should be noted that the embodiments described above are used to describe the present disclosure instead of limiting the present disclosure, and substitutive embodiments can be envisaged by those skilled in the art without departing from the scope of the appended claims. In the claims, no reference sign in parentheses should be construed as limiting the claims. A word "include" does not exclude elements or steps which are not listed in the claims. A word "one" or "an" before an element does not exclude multiple such elements. The present disclosure may be implemented by means of hardware including several distinct elements, and by means of a suitably programmed computer. In a unit claim enumerating a number of apparatuses, several of these apparatuses may be embodied by the same hardware item. Words "first", "second", "third" or the like are used without limiting an order. These words may be construed as names.

Finally, it should be illustrated that the various embodiments described above are merely used to illustrate the technical solutions of the present disclosure, instead of limiting the present disclosure. Although the present disclosure has been described in detail with reference to the various embodiments described above, it should be understood by those skilled in the art that the technical solutions recited in the various embodiments described above can still be modified or a part or all of the technical features therein can be equivalently substituted. These modifications or substitutions, which are made without the essence of the corresponding technical solutions departing from the scope of the technical solutions of the various embodiments of the present disclosure, should be included in the scope of the claims and specification of the present disclosure.

We claim:

1. A pixel circuit, comprising:

a light-emitting device, a driving transistor, a storage capacitor, a conducting unit, and an addressing unit, wherein, the driving transistor has one of a source and a drain connected to a control voltage line, and the other connected to the light-emitting device;

the storage capacitor has a first terminal connected to a gate of the driving transistor and a second terminal connected to the control voltage line;

the conducting unit has a first terminal connected to a scanning line, a second terminal connected to a data line, a third terminal connected to a first terminal of the addressing unit, and a fourth terminal connected to a common terminal, and is configured to conduct a connection between the second terminal and the third terminal when the first terminal is at a first level and conduct a connection between the third terminal and the fourth terminal when the first terminal is at a second level; and the addressing unit has a second terminal connected to the data line and a third terminal connected to the first terminal of the storage capacitor, and is configured to conduct a connection between the second terminal and the third terminal when the first terminal is at a valid level.

2. The pixel circuit according to claim 1, wherein the conducting unit comprises a first N-type transistor and a first P-type transistor, wherein the first N-type transistor has a gate connected to the scanning line, one of a source and a drain connected to the first terminal of the addressing unit, and the other connected to the common terminal;

the first P-type transistor has a gate connected to the scanning line, one of a source and a drain connected to the first terminal of the addressing unit, and the other connected to the data line; and the first level is a low level and the second level is a high level.

3. The pixel circuit according to claim 1, wherein the conducting unit comprises a second N-type transistor, a second P-type transistor, a third N-type transistor and a third P-type transistor, wherein the second N-type transistor has a gate connected to the scanning line, one of a source and a drain connected to gates of the third N-type transistor and the third P-type transistor, and the other connected to the common terminal;

the second P-type transistor has a gate connected to the scanning line, one of a source and a drain connected to the gates of the third N-type transistor and the third P-type transistor, and the other connected to the data line;

the third N-type transistor has one of a source and a drain connected to the first terminal of the addressing unit, and the other connected to the common terminal;

the third P-type transistor has one of a source and a drain connected to the first terminal of the addressing unit, and the other connected to the data line; and the first level is a high level and the second level is a low level.

4. The pixel circuit according to claim 1, wherein the conducting unit comprises a first N-type transistor and a first P-type transistor, wherein the first N-type transistor has a gate connected to the scanning line, one of a source and a drain connected to the first terminal of the addressing unit, and the other connected to the data line;

the first P-type transistor has a gate connected to the scanning line, one of a source and a drain connected to the first terminal of the addressing unit, and the other connected to the common terminal; and the first level is a high level and the second level is a low level.

5. The pixel circuit according to claim 1, wherein the conducting unit comprises a second N-type transistor, a second P-type transistor, a third N-type transistor and a third P-type transistor, wherein the second N-type transistor has a gate connected to the scanning line, one of a source and a drain connected to gates of the third N-type transistor and the third P-type transistor, and the other connected to the data line;

the second P-type transistor has a gate connected to the scanning line, one of a source and a drain connected to the gates of the third N-type transistor and the third P-type transistor, and the other connected to the common terminal;

the third N-type transistor has one of a source and a drain connected to the first terminal of the addressing unit, and the other connected to the data line;

the third P-type transistor has one of a source and a drain connected to the first terminal of the addressing unit, and the other connected to the common terminal; and the first level is a high level and the second level is a low level.

6. The pixel circuit according to claim 1, wherein the addressing unit comprises a P-type thin film transistor and the valid level is a low level.

7. The pixel circuit according to claim 1, wherein the light-emitting device is an organic light-emitting diode.

8. A method for driving the pixel circuit according to claim 1, comprising:

setting the scanning line to the first level, so that a data voltage on the data line is conducted to the first terminal of the addressing unit as an invalid level; and setting the scanning line to the second level, so that a common terminal voltage on the common terminal is conducted to the first terminal of the addressing unit as a valid level, the addressing unit conducts the data voltage on the data line to the first terminal of the storage capacitor, and the driving transistor supplies a driving current to the light-emitting device under the control of a voltage across the storage capacitor.

9. The method according to claim 8, wherein the addressing unit comprises a P-type thin film transistor and the valid level is a low level.

10. The method according to claim 8, wherein the light-emitting device is an organic light-emitting diode.

11. A display panel, comprising the pixel circuit according to claim 1.

12. A display apparatus, comprising the display panel according to claim 11.

13. The pixel circuit according to claim 2, wherein the addressing unit comprises a P-type thin film transistor and the valid level is a low level.

14. The pixel circuit according to claim 2, wherein the light-emitting device is an organic light-emitting diode.

15. The pixel circuit according to claim 3, wherein the addressing unit comprises a P-type thin film transistor and the valid level is a low level.

16. The pixel circuit according to claim 3, wherein the light-emitting device is an organic light-emitting diode.

17. The pixel circuit according to claim 4, wherein the addressing unit comprises a P-type thin film transistor and the valid level is a low level.

18. The pixel circuit according to claim 4, wherein the light-emitting device is an organic light-emitting diode.

19. The pixel circuit according to claim 5, wherein the addressing unit comprises a P-type thin film transistor and the valid level is a low level.

20. The pixel circuit according to claim 5, wherein the light-emitting device is an organic light-emitting diode.

* * * * *